US010238945B2

(12) United States Patent
Balent et al.

(10) Patent No.: US 10,238,945 B2
(45) Date of Patent: Mar. 26, 2019

(54) HEAD POSITION TRAINING DEVICE PROVIDING INSTANT FEEDBACK

(71) Applicants: Thomas Val Balent, Eldersburg, MD (US); Yuri Kostovetskiy, Laurel, MD (US); Mikhail Nasikan, Owings Mills, MD (US)

(72) Inventors: Thomas Val Balent, Eldersburg, MD (US); Yuri Kostovetskiy, Laurel, MD (US); Mikhail Nasikan, Owings Mills, MD (US)

( * ) Notice: Subject to any disclaimer, the term of this patent is extended or adjusted under 35 U.S.C. 154(b) by 156 days.

(21) Appl. No.: 15/132,217

(22) Filed: Apr. 18, 2016

(65) Prior Publication Data

US 2016/0303454 A1 Oct. 20, 2016

Related U.S. Application Data

(60) Provisional application No. 62/149,536, filed on Apr. 18, 2015.

(51) Int. Cl.

| | |
|---|---|
| ***G09B 19/00*** | (2006.01) |
| ***A63B 71/06*** | (2006.01) |
| ***A63B 69/00*** | (2006.01) |

(52) U.S. Cl.

CPC ..... *A63B 71/0622* (2013.01); *A63B 69/00* (2013.01); *A63B 69/0059* (2013.01); *A63B 2071/0627* (2013.01); *A63B 2071/0655* (2013.01); *A63B 2207/02* (2013.01); *A63B 2209/10* (2013.01); *A63B 2220/56* (2013.01); *A63B 2244/12* (2013.01)

(58) Field of Classification Search

USPC ..... 434/247, 262; 5/636, 637, 640; 297/392, 297/393; 602/18

See application file for complete search history.

(56) References Cited

U.S. PATENT DOCUMENTS

| | | | | | |
|---|---|---|---|---|---|
| 4,565,408 | A * | 1/1986 | Palley | A47C 7/383 | 297/392 |
| 4,700,697 | A * | 10/1987 | Mundell | A61F 5/055 | 128/DIG. 23 |
| 5,029,577 | A * | 7/1991 | Sarkozi | A61F 5/055 | 602/18 |
| 6,135,560 | A * | 10/2000 | Fagg | A47G 9/007 | 297/391 |
| 6,219,865 | B1 * | 4/2001 | Stokesbary | A47G 9/10 | 297/392 |

(Continued)

*Primary Examiner* — Kurt Fernstrom

(74) *Attorney, Agent, or Firm* — White-Welker & Welker, LLC; Matthew T. Welker, Esq.

(57) ABSTRACT

A two part device for teaching a wearer to maintain a neutral head position while performing an action, like a gymnastics move. The device comprises a top part having a flat top surface and a thickness that is shaped to curve around the neck of a wearer and a bottom part shaped like a wedge which is securely connected to the top part on one end while the opposing end presses into the sternum or chest area of a wearing when the top part is positioned around the neck. The device is placed around the neck and pressed against the sternum or chest area of a user to ensure the wearer's head is in a neutral position. If the wearer performs the action and the device remains in place, the wearer knows that their head remained in a neutral position during the entire action, providing instant feedback.

14 Claims, 9 Drawing Sheets

(56) References Cited

U.S. PATENT DOCUMENTS

| | | | | |
|---|---|---|---|---|
| 6,231,535 | B1 * | 5/2001 | Mainiero | A47C 7/383 5/636 |
| 6,289,538 | B1 * | 9/2001 | Fidge | A47C 7/383 297/393 |
| 6,625,829 | B2 * | 9/2003 | Zell | A47C 7/383 128/DIG. 23 |
| 6,969,366 | B1 * | 11/2005 | Reddick | A61F 5/3707 602/18 |
| 7,055,908 | B1 * | 6/2006 | Williams | A47C 7/383 297/392 |
| 7,500,279 | B2 * | 3/2009 | Jackson | A47C 7/383 128/845 |
| 7,789,843 | B2 * | 9/2010 | Ray | A61F 5/56 128/845 |
| 7,885,713 | B2 * | 2/2011 | Campbell | A61N 1/3601 602/18 |
| 8,382,692 | B1 * | 2/2013 | Chao | A47C 7/383 128/845 |
| 8,814,106 | B2 * | 8/2014 | Aguilera | B60N 2/4879 248/118 |
| D712,556 | S * | 9/2014 | Abbey | A42B 3/0473 D24/191 |
| 9,027,185 | B2 * | 5/2015 | Garcia | B60N 2/4879 5/636 |
| 2009/0235937 | A1 * | 9/2009 | Derrick | A47C 16/00 128/845 |

* cited by examiner

HEAD POSITION TRAINING DEVICE PROVIDING INSTANT FEEDBACK

CROSS REFERENCE TO RELATED APPLICATIONS

This application claims priority from U.S. Patent Application Ser. No. 62/149,536, entitled "Head Position Training Device Providing Instant Feedback", filed on 18 Apr. 2015. The benefit under 35 USC § 119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to sports equipment. More specifically, the present invention relates a device for maintaining the head in a neutral position during sports training.

BACKGROUND OF THE INVENTION

Increasingly in sports, head position is becoming more and more of an important issue, not only for performance, but also for safety. Gymnastics as well as many other sports usually require that a participant learn to identify chin/head in and chin/head out positions, neutral head position, as well as turn/side-tilt positions. In order to learn these positions and to recognize when a participant is using the muscles in the neck to hold a position of the head, feedback is necessary. Typically feedback comes from coaches during practice, other participants, or by reviewing video footage at a later time. Therefore, what is needed is a simple device that teaches a participant using the device to keep their head in a desired position and that provides instant feedback when the head leaves the desired position which was attempted to be maintained by the participant during the exercise or action.

SUMMARY OF THE INVENTION

The present invention consists of a two parts, a top part having a flat top surface and a thickness that is shaped to curve around the neck of a wearer and a bottom part shaped like a wedge which is securely connected to the top part on one end while the opposing end presses into the sternum or chest area of a wearing when the top part is positioned around the neck.

The device is placed around the neck and pressed against the sternum or chest area of a user to ensure the wearer's head is in a neutral position for performing a gymnastic action. Instant feedback is provided during the use of the device. If the wearer performs the action and the device remains in place, the wearer knows that their head remained in a neutral position during the entire action. If the device slips, moves, or falls out completely during the action event, the wearer is provided with instant feedback that either not enough pressure was applied to the device or their head moved from the neutral position to an open position, which resulted in the loss of the device from its location between the next and sternum/chest area.

BRIEF DESCRIPTION OF THE DRAWINGS

The accompanying drawings, which are incorporated herein a form a part of the specification, illustrate the present invention and, together with the description, further serve to explain the principles of the invention and to enable a person skilled in the pertinent art to make and use the invention.

DEFINITIONS

Head In/Out: A gymnasts head is "in" when their chin is tucked on their chest, or close to. A gymnasts head is out when their head is tilted back.

Neutral Position: If a person stands with their body still and looks straight ahead, the head, in this position, is said to be in the neutral or level head position.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
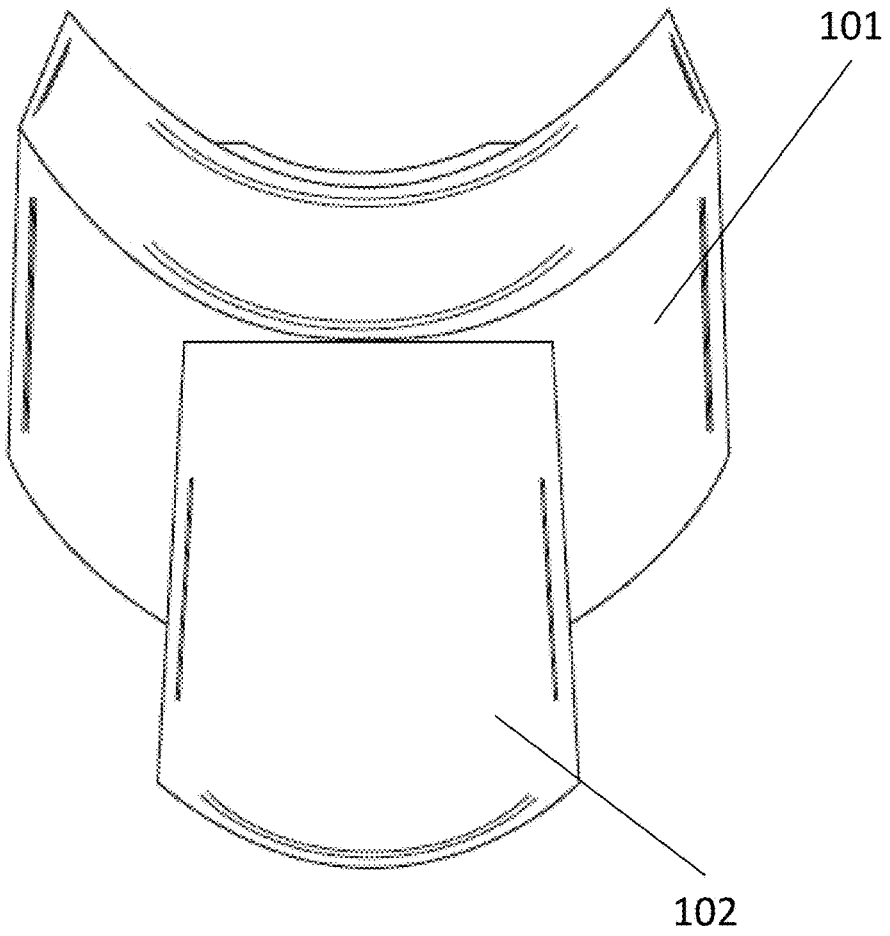
FIG. 1 is the representation of a perspective view of one embodiment of the present invention.

Now referring to Figures, the embodiments of the head position training device are shown. FIG. 1 is the representation of a perspective view of one embodiment of the present invention. The present invention is comprised of two parts, a top part 101 and a bottom part 102. The top part 101 is "U" shaped and intended to fit around the front neck area of a person and extend no further back than the chin area. The bottom part 102 is "wedge" shaped and is attached to the top part 101. The bottom part 102 is of a sufficient length to be pressed into the sternum or chest area of a wearer while the top part 101 is wrapped around the neck area, under the chin so that the wedge length of the bottom part 102, when held in place by the user applying pressure on the top surface of the top part 101 to retain the device between the chin and chest/sternum area, places the head in a neutral position.

In the embodiment shown in FIGS. 1-6, the top surface 103 of the top part 101, which is the surface that engages and contacts the chin area is also provided with a bump 104. The bump 104 on the top surface 103 of the top part 101 provides a protrusion, in the form of the bump 104, that a wearer can use to better grip or retain the device under the chin while maintaining the head in a neutral position.

Figure 2:
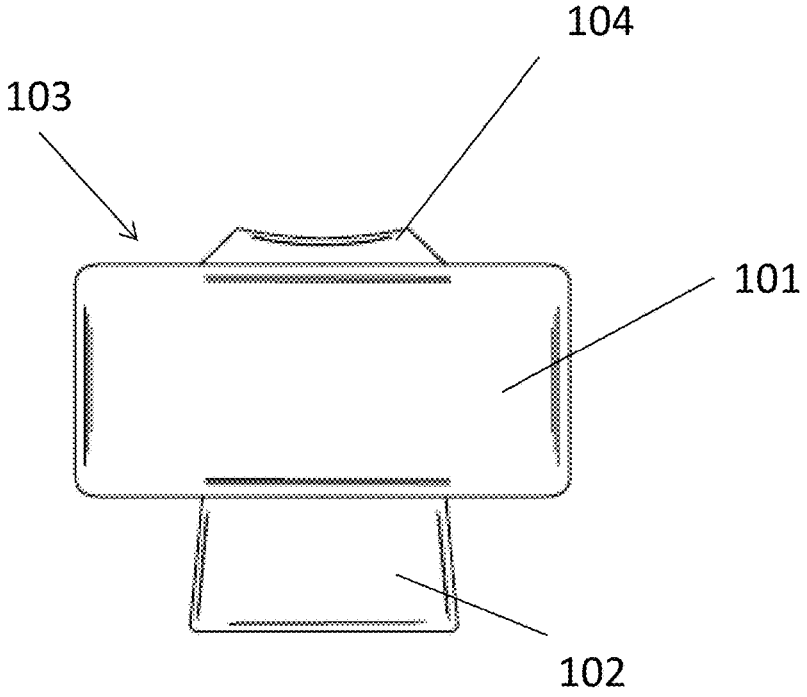
FIG. 2 is the representation of a front view of one embodiment of the present invention.
Figure 3:
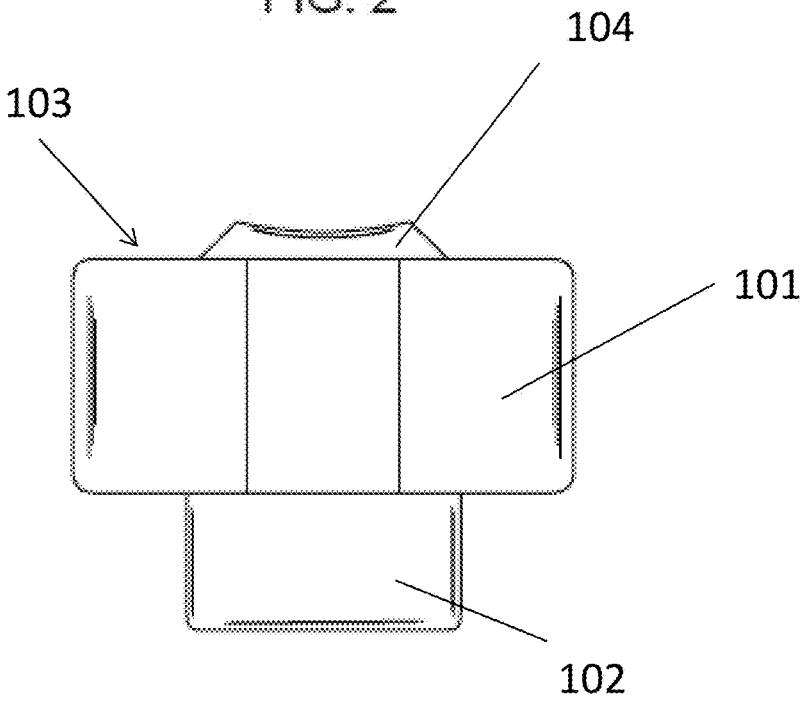
FIG. 3 is the representation of a back view of one embodiment of the present invention.

A front view of one embodiment of the present invention and a back view of one embodiment of the present invention are represented in FIGS. 2-3. In these views the bump 104 on the top surface 103 is clearly visible. The bump 104 can be flat or also slightly curved as shown to better engage the chin of a wearer. The portion of the top part 101 facing away from the neck 105 is also typically curved, making the top part 101 appear as a "u" shape, but could be of any shape. The portion of the top part that engages the neck 106 and is opposite the top part facing away from the neck 105 is shaped into a "U" curve of varying size to accommodate the varying size of wearers from children to adults.

Figure 4:
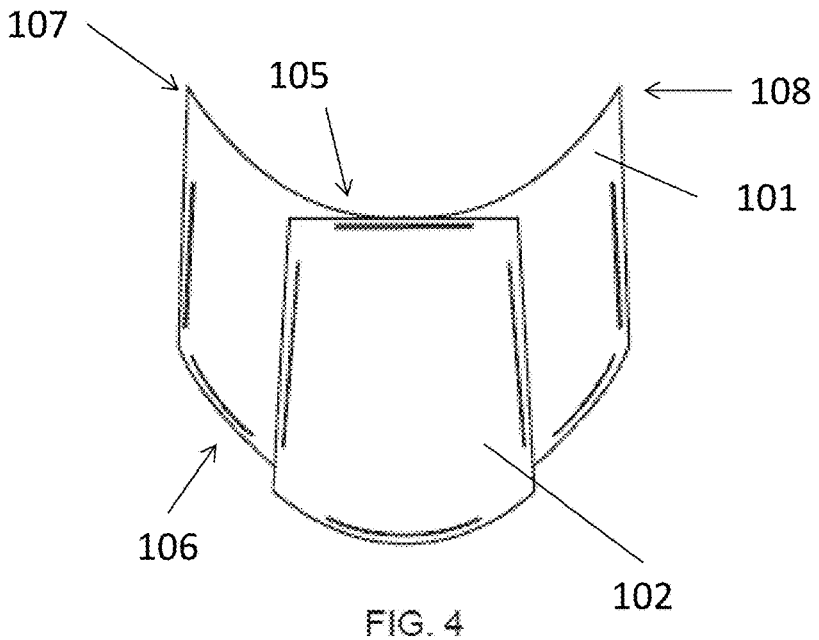
FIG. 4 is the representation of a top view of one embodiment of the present invention.
Figure 5:
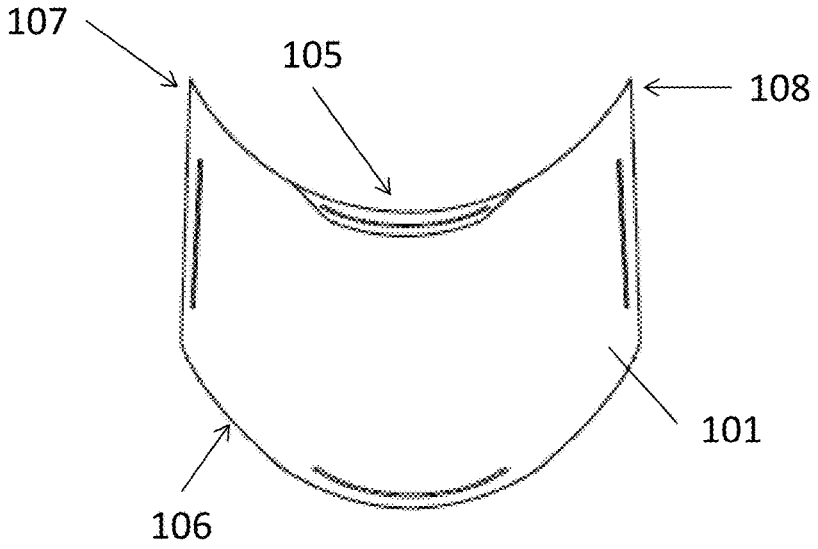
FIG. 5 is the representation of a bottom view of one embodiment of the present invention.

FIGS. 4-5 are representations the top and bottom views of one embodiment of the present invention. In these figures the "U" shape of the top portion 101 is clearly visible. In this embodiment, the "U" shape only extends to the chin area of a wearer. In another embodiment of the present invention, the sides ends of the "U" 107 and 108 can be extended in back further to wrap around the side of a wearer's neck. In one embodiment, the "U" 105 could extend up to half way around the side of the wearer's neck.

Figure 6:
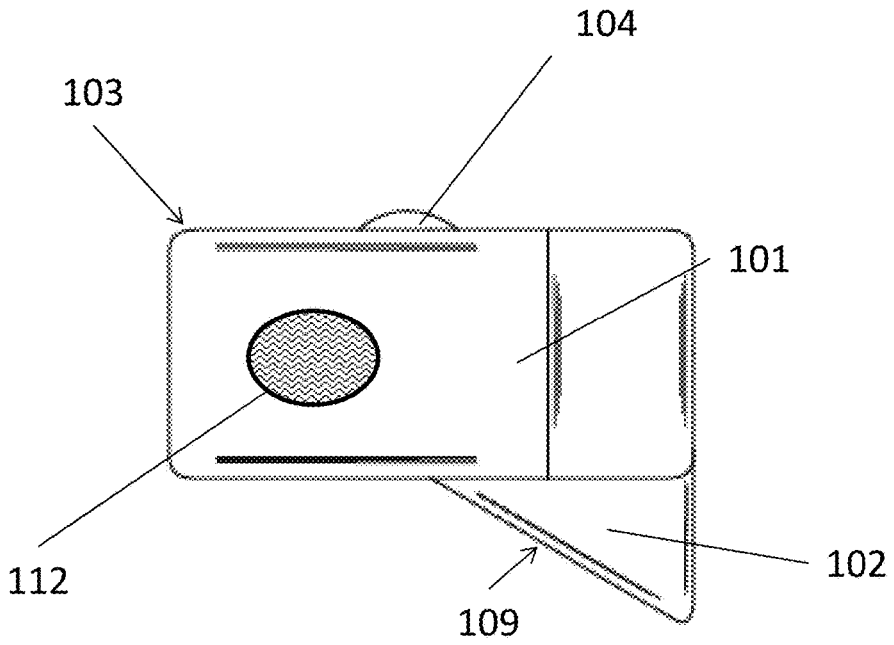
FIG. 6 is the representation of a left view of one embodiment of the present invention.
Figure 7:
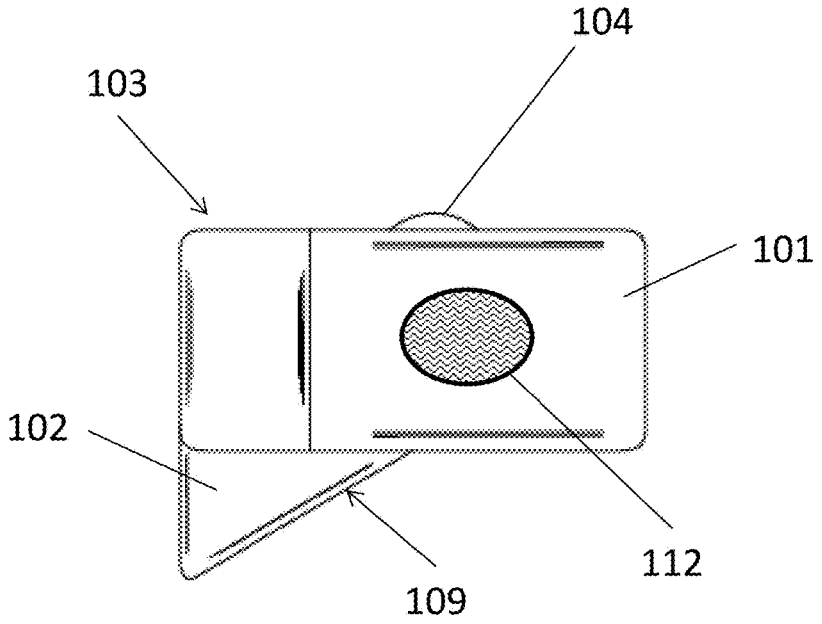
FIG. 7 is the representation of a right view of one embodiment of the present invention.

FIGS. 6-7 are representations of the side views of one embodiment of the present invention. In these figures the wedge shaped bottom piece is clearly visible. The angle of the wedge can be change or adjusted as necessary to provide differing shapes for different body sizes and shape of a wearer's sternum/chest area. In addition to varying the angle, the length of the wedge and angled surface/side/edge can be adjusted longer or shorter as well. By increasing or decreasing the slope of the wedge, the fit can be change for wearer's of varying size as the angle and length of the wedge of the bottom part would be very different for children of varying ages, adolescents, and adults.

FIGS. 6-7 also show the bump 104 on the top surface 103 of the top part 101. The bump 104 can be flat or also slightly curved as shown to better engage the chin of a wearer. In this embodiment, the bump 104 is shown with a rounded edge and top, but other shapes could also be used but the use of a shape with an edge would likely be very uncomfortable, so a rounded shape was chosen by the Inventors.

Figure 8:
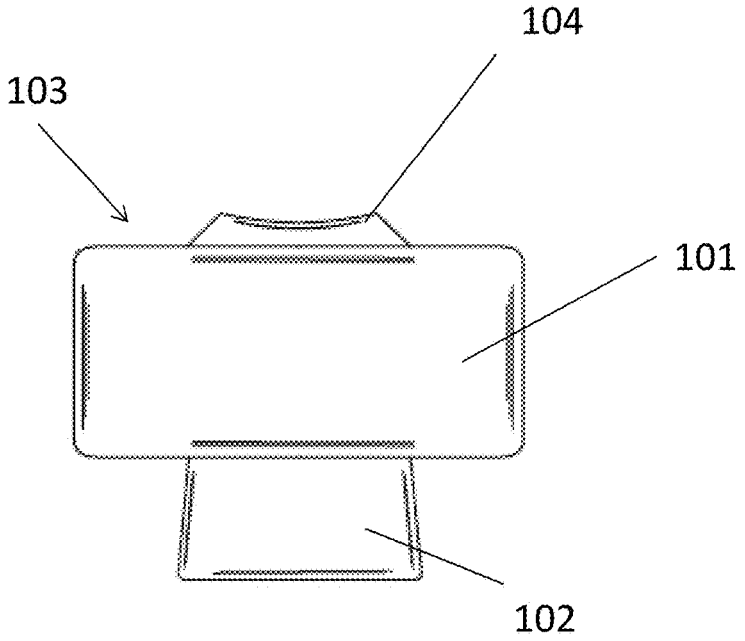
FIG. 8 is the representation of a front view of an one embodiment of the present invention.
Figure 9:
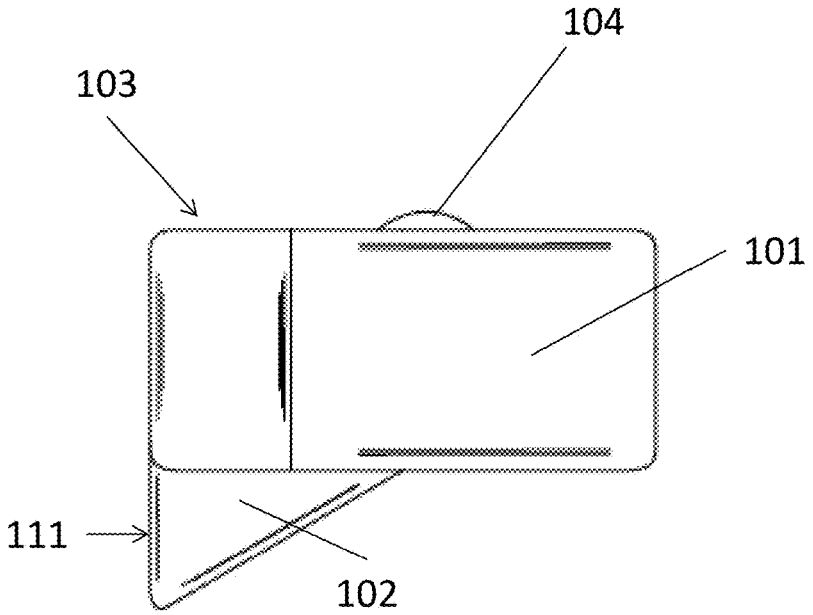
FIG. 9 is the representation of a right side view of an one embodiment of the present invention.

FIGS. 8-9 are representations of the side views of and alternative embodiment of the present invention here there is no bump on the top surface 103 of the top portion 101. In these figures the wedge shaped bottom piece 102 is clearly visible. The angle of the wedge 109 can be changed or adjusted as necessary to provide differing shapes for different body sizes and shapes of a wearer's sternum/chest area 110. In addition to varying the angle 109, the length 111 of the wedge 102 and angled surface/side/edge can be adjusted longer or shorter as well. By increasing or decreasing the slope of the wedge angle 109 the fit can be change for wearer's of varying size as the angle 109 and length 111 of the wedge of the bottom part 102 would be very different for children of varying ages, adolescents, and adults.

In yet another embodiment, the wedge of the bottom part 102 may be construction of one or more pieces. Using multiple pieces allows for the changing and customizing the length 111 and angle 109 of the device for use a larger amount of users of varying body shapes and sizes.

Additionally, the embodiments shown in FIGS. 6-9 shown the device made as two parts. In more alternative embodiments, the device's two parts may be integrated and molded into one part during the manufacturing process. During the manufacturing process, in either a one piece or two-piece construction, the device may further receive a vinyl dipping or other coating for durability and cleanliness, friction, or sanitary purposes. The device would typically be made from a foam material in either a one or two piece construction. Material selection for the device includes rubber, foam, plastic, nylon, silicone, latex, vinyl, composites, polyethylene foam, EVA foam, memory foam, Expanded PolyPropylene (EPP), Expanded PolyUrethane (also abbreviated PU or EPU), Expanded PolyStyrene (EPS), 1.5 lb x-link closed cell foam, or any combination thereof for the top and bottom parts.

Also, during manufacturing, the device may have its edged beveled or made from different shapes to accommodate different users and for improved comfort. The surface may also be treated or covered in a separate material to increase friction so that the device is easier to retain in place. The top and bottom parts 101 and 102 may or may not be comprised of materials with varying or different coefficients of friction.

Figure 10:
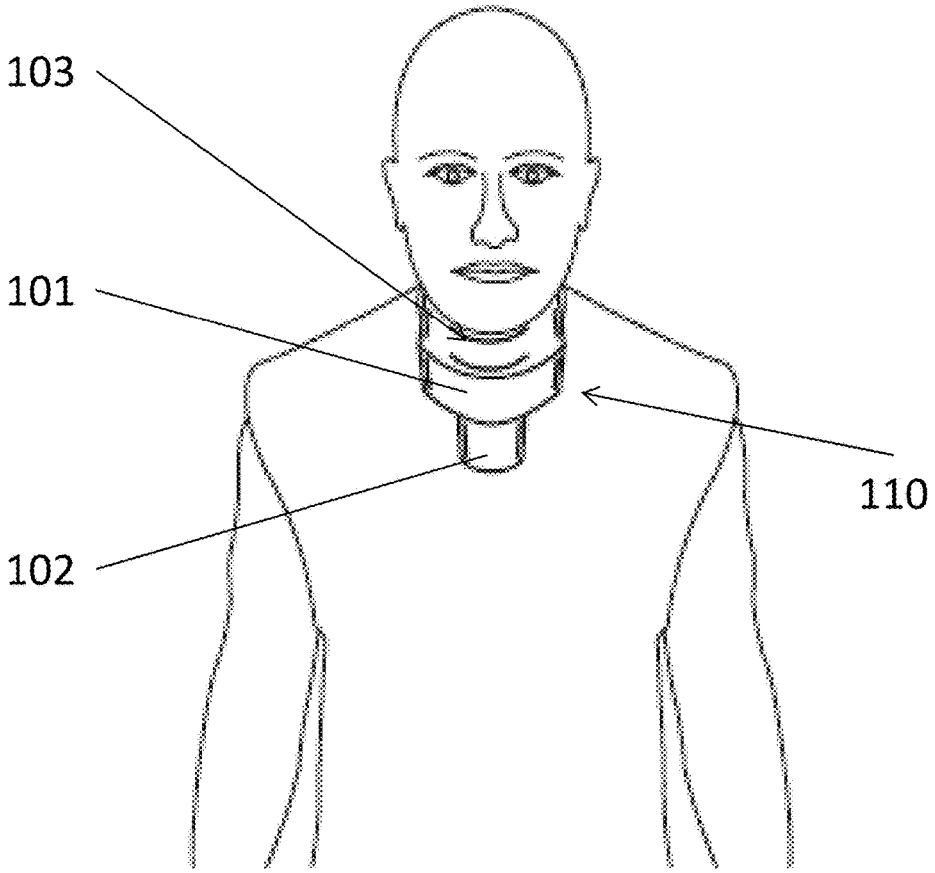
FIG. 10 is a front view of one embodiment of the present invention in use on a person.

FIG. 10 is a front view of one embodiment of the present invention in use on a person. In this illustration one can clearly see how the top part "U" shaped portion 101 fits around the neck and under the chin. The bump 104 on the top surface of the top part 101 is also visible under the chin of the wearer. This bump 101 serves to provide an area of better grip for retaining and holding the device in place. The bottom part wedge 102 is also clearly shown connected to the top part 101 and engaging the sternum/chest area 110 of a wearer who is holding the device in place be creating a squeezing force or pressure by trying to push the chin down toward the sternum/chest area with the device in place forcing the head to remain in a neutral position.

Figure 11:
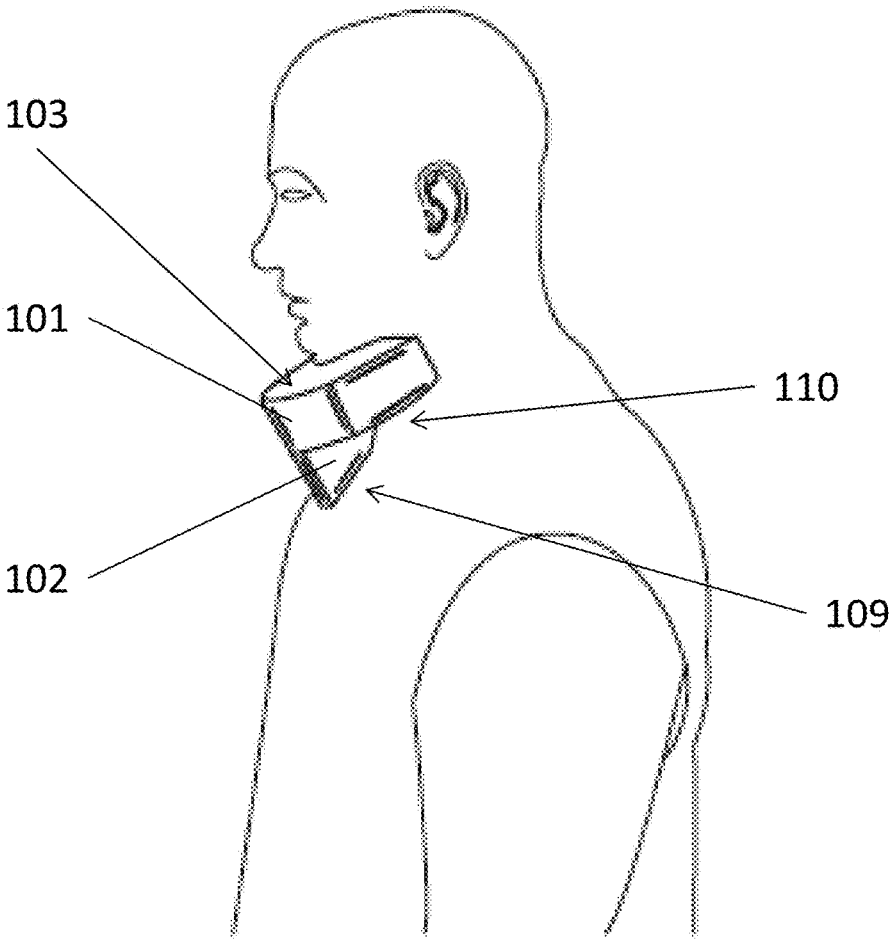
FIG. 11 is a side profile view of one embodiment of the present invention the device in use on a person.
Figure 12:
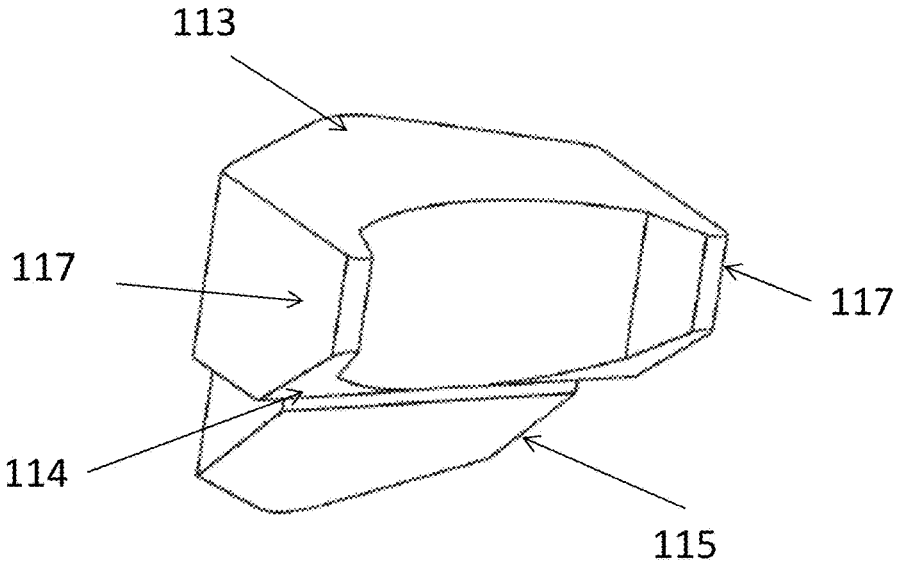
FIG. 12 is a perspective view of an alternative embodiment of the present invention.
Figure 13:
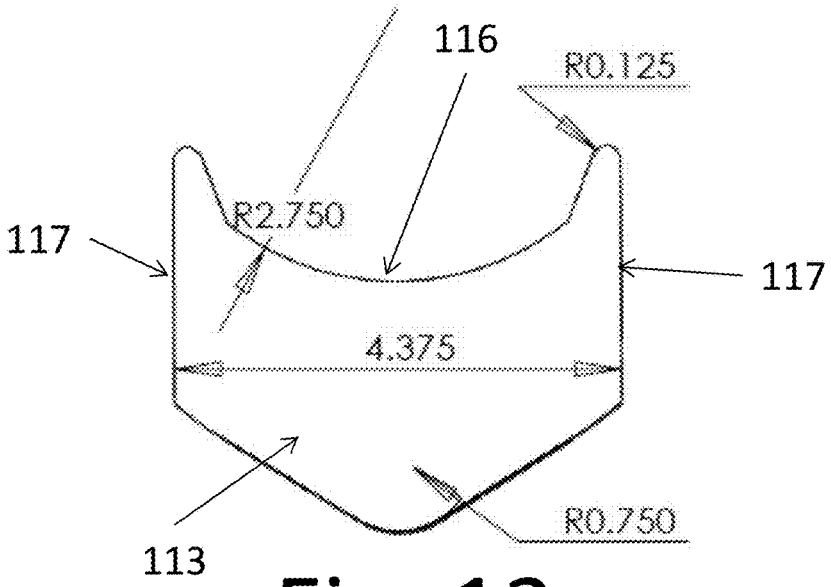
FIG. 13 is the representation of a top planar view of an alternative embodiment of the present invention.
Figure 14:
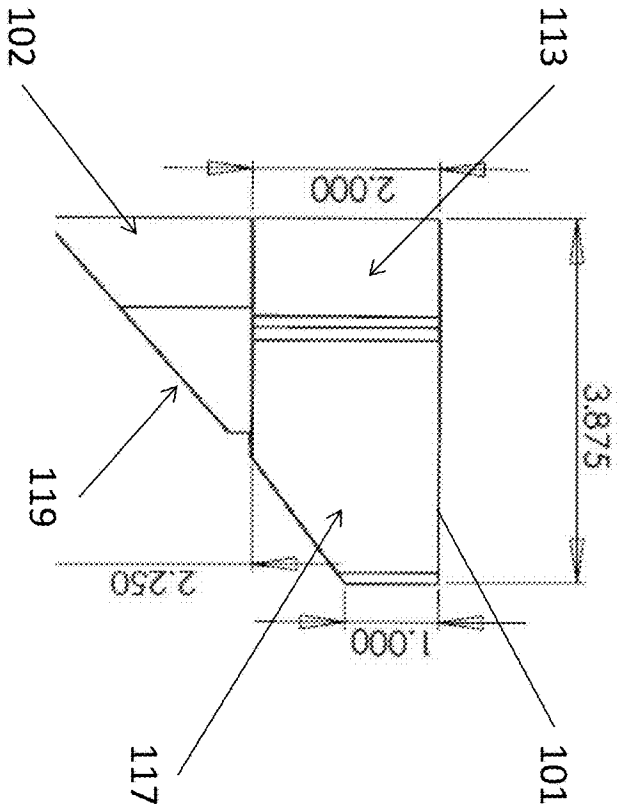
FIG. 14 is the representation of a side planar view of an alternative embodiment of the present invention.
Figure 15:
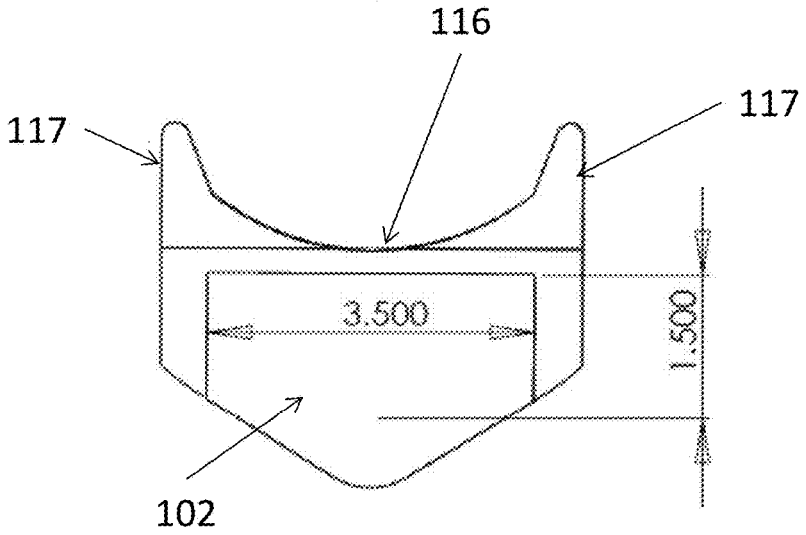
FIG. 15 is the representation of a bottom planar view of an alternative embodiment of the present invention.

FIG. 11 is a side profile view of one embodiment of the present invention the device in use on a person. In this illustration one can clearly see how the top part "U" shaped portion 101 fits around the neck and under the chin. The bottom part wedge 102 is also clearly shown connected to the top part 101 and engaging the sternum/chest area 110 of a wearer who is holding the device in place be creating a squeezing force or pressure by trying to push the chin down toward the sternum/chest area 110 with the device in place forcing the head to remain in a neutral position.

Here the appearance of two angles is subtly shown in the drawing. The first angle is the angle 109 of the bottom wedge part 102.

Now referring to FIGS. 12-15, an alternative embodiment of the present invention is illustrated. In this embodiment, the device includes an added extrusion for the chin 113, a trimmed outside edge 114, a changed angle 115, a deeper neck cutout 116, and added support wings to the sides of the neck cut out 117. Dimensions are shown for one specific embodiment of the top part 101 and bottom part 102, but it is understood that the dimensions are flexible and are adjustable to ensure the device fits users of varying size, weight, and build, as well as to provide adjustability in the angle 119. Overall function has not changed, the device still helps train the neutral head positioning and results in a decreased excessive head movement across any sport or activity, especially in sports where the head may come into contact with equipment, another person, or a fixed object such as a floor, wall, or equipment like that in gymnastics where having the head in a neutral position greatly reduces the chances of severe injury or death in the event of a forceful impact.

In some embodiments of the present invention, two or more wedge portions 102 may be securely fastened to each other and a top portion 101 to ensure a better and more accurate fit to a wearer of the device and allow for multiple top parts 101 and bottom parts 102 to be removeably attached to each other so they can be mixed and matched by wearers of varying sizes and shapes. In a removeably attached scenario, the parts would likely be comprised of VELCO, a hook and loop attachment means, or equivalent which would allow for the quick combination or removal of top and bottom sections 101 and 102, or the combination of top sections 101 and bottom sections 102 of varying size to provide a more custom fit to the wearer.

In yet another embodiment of the invention, in either the one or multi-part embodiments, the top and bottom section or entire device can be an inflatable design, which varying air pressure used to adjust fit and support.

In still other embodiments of the present invention, one or more sensors 112 can be placed in the top and/or bottom portions 101 and 102 of the device. The sensors 112 can be pressure sensors for measuring the force used to hold the device in place during an action or exercise. Sensors 112 may also be incorporated to measure the motion of the device during an exercise or action. The data may then be downloaded to a computer or other mobile electronic device for review. Such review could not only show the pressuring being applied to the device, but the motion of the device over a period of time during the execution of an action or activity to identify when and where a problem keeping the head in a neutral position or a tendency to tighten the next in an effort to force it into the chest during an action or exercise.

With the use of sensors 112, the device can also be provided with audio and visual alerts for tracking holds and losses of the device during an action or exercise and providing audio feedback/output.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A device for retaining a wearer's head in a neutral position comprising:
- a top part,
  - the top part having a flat top surface and curved sides for being placed partially around the next of a person;
  - wherein the top part is further comprised of one or more sensors and one or more lights for providing additional information and feedback;
- a bottom part,
  - the bottom part in the shape of a wedge wherein one end of the wedge is secured to the top part and the opposing end of the wedge is provided with an angle for engaging the sternum or chest area of a wearer when the top part is placed around a wearer's neck.

2. The device of claim 1, wherein
- the top part and bottom part are formed individually from 1.5 lb x-link foam;
- the top part and bottom part are glued together; and
- the combined top part and bottom part are coated in vinyl via a dipping process.

3. The device of claim 1, wherein the top part and bottom part are made from a polyethylene foam, EVA foam, memory foam, Expanded PolyPropylene (EPP), Expanded PolyUrethane (also abbreviated PU or EPU), Expanded PolyStyrene (EPS), 1.5 LB x-link foam or any combination thereof for the top and bottom parts.

4. The device of claim 1, wherein the top part is further comprised of a bump or ridge on the top surface following the contour of the curve at the top surface edge which makes contact with the neck when in use.

5. The device of claim 1, wherein the top part is further comprised of a contour or beveled edge.

6. The device of claim 1, wherein the top part uses the sensors to track holds and losses.

7. The device of claim 1, wherein the top part is further comprised of a speaker providing audio feedback from the sensors.

8. The device of claim 1, wherein the top part extends past the chin area and surrounds up to 50% of the circumference of the neck.

9. The device of claim 1, wherein the top part does not extend past the chin.

10. The device of claim 1, wherein the top part is detachably removable from the bottom part.

11. The device of claim 1, wherein the bottom part is made from or covered by a material with a different coefficient of friction compared to the top part.

12. The device of claim 1, wherein the top part and the bottom part are integrated into one piece.

13. The device of claim 12, further comprising
- an added extrusion for the chin;
- a trimmed outside edge; and
- support wings added to the sides of the neck cutout.

14. The device of claim 13, wherein,
- the angle of support is adjustable.

* * * * *